United States Patent [19]

Bleichwehl et al.

[11] Patent Number: 5,050,660

[45] Date of Patent: Sep. 24, 1991

[54] SCREEN DOOR FOR LARGE DOOR OPENING

[76] Inventors: Ralph E. Bleichwehl, P.O. Box 2466, 1222 West 18th, Oshkosh, Wis. 54903-2466; Jeff M. Nason, 320 Westbrook Dr., Oshkosh, Wis. 54901

[21] Appl. No.: 519,502

[22] Filed: May 7, 1990

[51] Int. Cl.[5] ..... E06B 3/48

[52] U.S. Cl. ..... 160/113; 160/201

[58] Field of Search ..... 160/113, 201, 40, 191, 160/192, 193, 115

[56] References Cited

U.S. PATENT DOCUMENTS

| | | | |
|---|---|---|---|
| 2,072,092 | 3/1937 | Blodgett | 160/113 |
| 3,021,896 | 2/1962 | Buono et al. | 160/113 |
| 3,103,967 | 9/1963 | Gaschen | 160/113 |
| 3,104,699 | 9/1963 | Wolf et al. | 160/201 X |
| 3,226,144 | 12/1965 | Lomaz | 160/40 X |
| 4,276,919 | 7/1981 | Walters | 160/199 X |
| 4,793,397 | 12/1988 | Whiteman | 160/201 |

*Primary Examiner*—David M. Purol

*Attorney, Agent, or Firm*—Fuller, Ryan & Hohenfeldt

[57] ABSTRACT

Screening overhead door apparatus for screening a doorway, and for addition to existing overhead door apparatus, including a plurality of additional door panels hingedly attached together and provided with openings covered with foraminous material. An L-shaped track for mounting the additional door panels is attached to the existing track, and positioned inside and beneath the existing track. The additional door panels are mounted to the additional track by rollers journaled to brackets attached to the panels. As the rollers run along the track, the additional door panels move from a first position closing the doorway to a second position clearing the doorway. The uppermost panel is attached to the uppermost set of rollers by a slidable bracket, thus permitting the distance between the additional track and the uppermost edge of the panel to be easily altered. The uppermost panel edge is releasably attached to the top edge of the doorway in suitable manner such as magnetic, mutually attractive strips affixed to both the top edge of the doorway and the uppermost panel edge, or a releasable latch applied to both the doorway and the uppermost panel edge to latch them together. Counterweighting apparatus is provided for counterbalancing some of the weight of the screen door, to facilitate the lifting and opening of the screen door.

12 Claims, 3 Drawing Sheets

SCREEN DOOR FOR LARGE DOOR OPENING

BACKGROUND OF THE INVENTION

This invention relates to garage doors for closing the large opening in garages, shops or other areas of activity, and in particular to such doors of a foraminous nature, for closure of the large opening of a structure of the type found in residential, commercial or industrial areas, while permitting air circulation through the door.

It is sometimes desirable to permit entry of light, and free air circulation, into and through a building such as a garage, shop or other activity area such as when activities are planned to be had therein. In some areas of the country, however, insects and other pests make it uncomfortable to simply open the existing door and leave it open to admit light and air. In addition, it may be desirable to permit pets and children play or exercise in the building while restraining them from leaving. Therefore it is clear that there is a need for a foraminous closure member which can be quickly and easily placed in front of the large door opening when the main door itself is opened, and later just as quickly and easily removed. Multipurpose usage of existing buildings provide distinct advantages to users.

Certain door structures have been proposed in the past to answer this need. For instance, in Stansberry, U.S. Pat. No. 3,178,776, there is disclosed a system of interchangeable panels in the main garage door, some of which panels are screened or foraminous. The patent to Church, U.S. Pat. No. 4,141,403, shows a "jalousie" arrangement, wherein several of the door panels of the garage main door are pivoted outward, with screened panels behind, to admit air. To add either of these structures to an existing garage, however, requires the entire removal and replacement of the existing main garage door.

In another example, Sorenson, U.S. Pat. No. 4,378,043 proposes a foraminous panel to be pivotably attached to the bottom of the main garage door, for permitting a limited amount of air circulation. Because of its position at the bottom of the doorway, though, its admittance of air is minimal and its admittance of light is even less.

The Antinone patent, U.S. Pat. No. 3,763,917, shows a screen member attached across the entire main garage door opening. While this may be satisfactory for some applications, it may be desirable to have a more permanent installation of the screening member.

Such permanence would require the screening member to be retractable, however, so that the main, solid garage door would still be available for use. Such a permanently attached, retractable screening member is shown in Gaschen, U.S. Pat. No. 3,103,967. In that structure, similar to a conventional garage door, the screened door is provided in the form of articulated frames, running along a track. The track of that structure, however, is disclosed to be installed between the existing track of the main garage door and the doorway. This is a big job, and the result is that the installation of that structure outside of the ability of the average homeowner. A building or carpentry contractor would have to be employed. Further, use by a renter is also substantially precluded. What is needed is a relatively permanently installed screen-type door to be installed by any homeowner or renter so that it may be easily and quickly slid into place and just as easily and quickly out of the way of the main large door.

This invention relates to improvements to the structure set forth above and to solutions to the problems raised or not solved thereby.

SUMMARY OF THE INVENTION

This invention includes screening overhead door apparatus for screening a doorway, and for addition to existing overhead door apparatus. Generally such existing overhead door apparatus includes a plurality of door panels hingedly attached together one above another when in a closed position. A track is provided for moving the existing overhead door apparatus between the closed position and an open position clear of the doorway. According to the invention, the screening door apparatus comprises a plurality of additional door panels hingedly attached together. At least some of these additional panels are provided with openings and covered with foraminous material. A track for mounting the additional door panels is attached adjacent to the existing track so that the existing track remains directly adjacent to the sill of the doorway. Similar to the existing track, the additional track has a vertical portion, attached directly adjacent to the existing track, and an overhead, horizontal portion connected to and above the vertical portion. The overhead, horizontal portion of the additional track is also attached to the overhead horizontal portion of the existing track and spaced below it. The additional door panels are mounted to the additional track by sets of rollers, each roller of the set being journaled to one of a set of brackets attached to each of the panels. By this means, as the rollers run along the track, the additional door panels may be moved from a first, vertical position adjacent to and closing the doorway, to a second, overhead position clearing the doorway. The uppermost of the panels is hingedly attached to the panel below it, and attached to the uppermost set of rollers by means of a slidable bracket, thus permitting the uppermost edge of the panel to be easily pushed closed after the door is lowered and clears the existing door. Attachment means are provided for releasably attaching the uppermost panel edge to the top edge of the doorway once the screen door is lowered into closed position. The attachment means may include magnetic, mutually attractive strips affixed to both the top edge of the doorway and the uppermost panel edge, or releasable latch means applied to both the doorway and the uppermost panel edge to latch them together. The uppermost panel is opened, with just as little effort, before raising the door. Spring biasing means are generally provided for counterbalancing some of the weight of the screen door, to facilitate the lifting and opening of the screen door by persons of wide-ranging sizes and strengths.

Thus the invention provides a simple installation wherein a second door track is attached to an existing door track, requiring minimal changes to the building structure. This simplified installation makes use of the invention feasible for renters as well as owners.

Other objects and advantages of the invention will become apparent hereinafter.

DESCRIPTION OF THE PREFERRED EMBODIMENT

Figures 1, 3, 4:
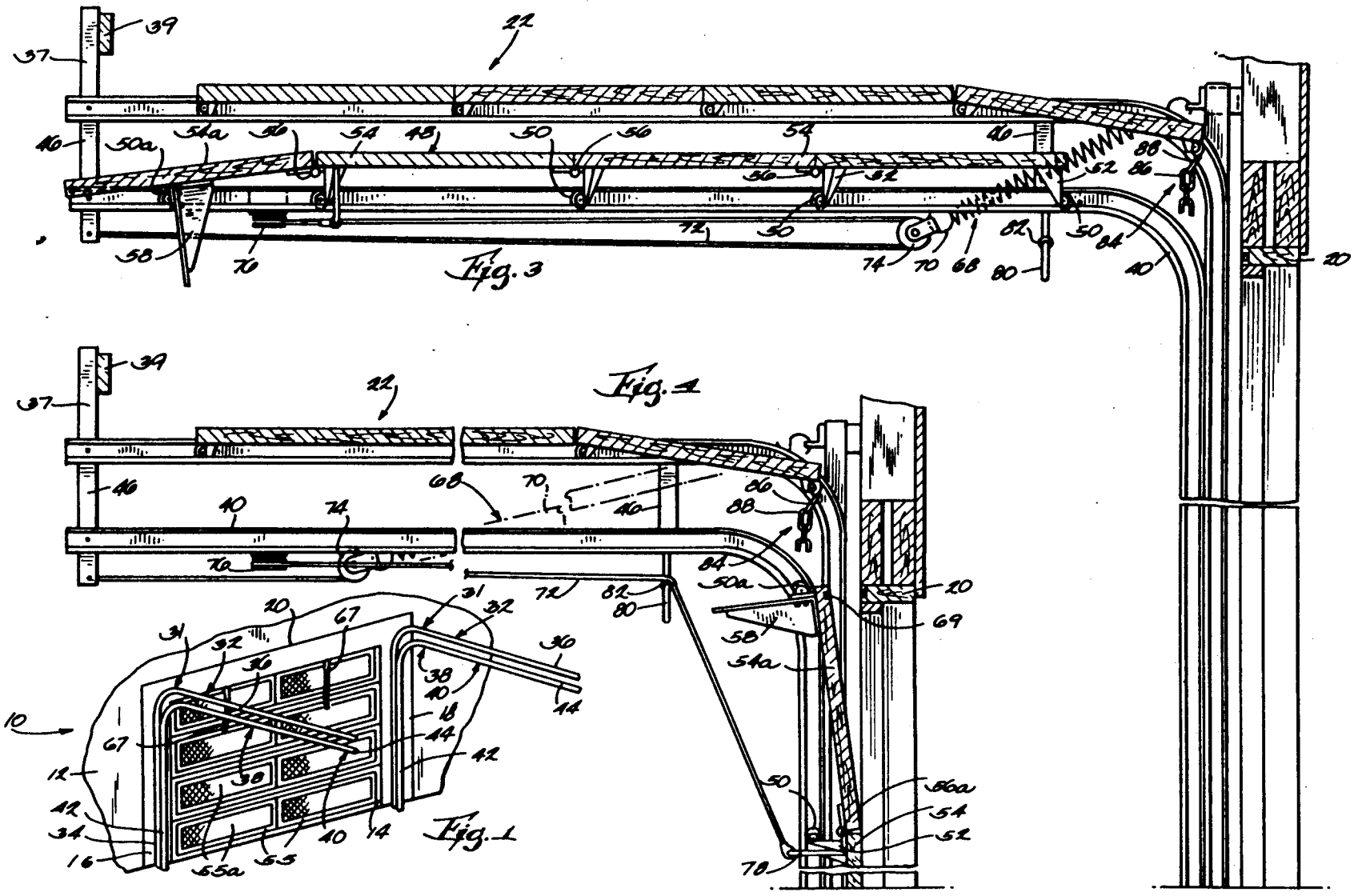
FIG. 1 is an isometric view, somewhat schematic, of the large doorway of a garage, showing dual tracks and a closed screen door according to a preferred embodiment of the invention.
FIG. 3 is a side elevational view, partially in section, of a door assembly according to a preferred embodiment of the invention, with both the existing door and the screen door in the raised position.
FIG. 4 is a side elevational view, partially in section, of a door assembly according to a preferred embodiment of the invention, with the existing door in its raised position and the screen door in the lowered position, but with the top panel of the screen not closed.
Figures 2, 9, 10:
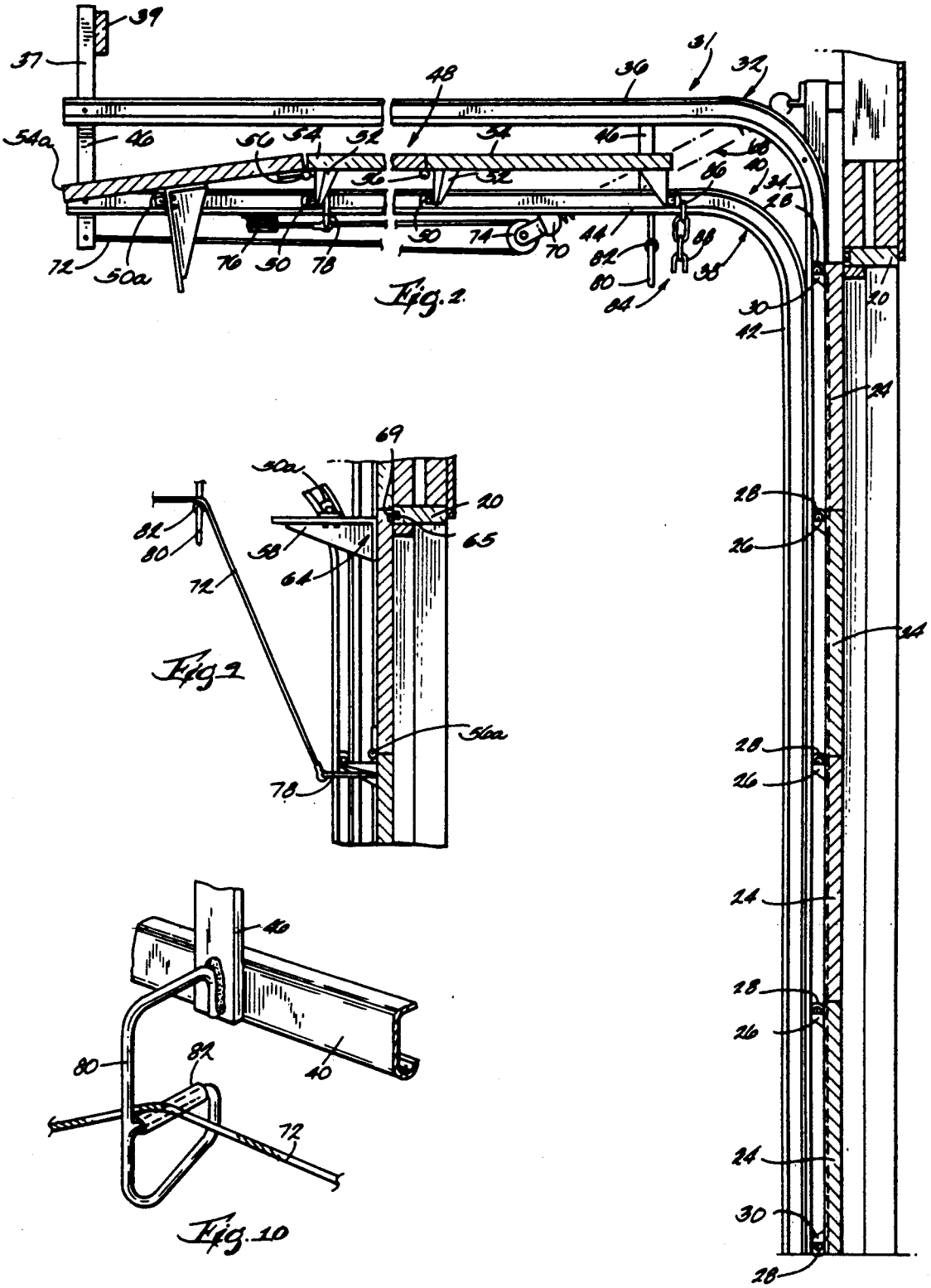
FIG. 2 is a side elevational view, partially in section, of a door assembly according to a preferred embodiment of the invention, with the existing door in its lowered position and the screen door in the raised position.
FIG. 9 is a side view of the screen door according to invention with the top panel closed.
FIG. 10 is an isometric view of a cable guide assembly according to a preferred embodiment of the invention.

Referring now to FIGS. 1 and 2, there is shown part of a conventional enclosure 10, such as for a garage. The enclosure 10 includes a wall 12 having a large opening or doorway 14 formed therein. The doorway 14 is defined by a pair of spaced apart, vertical support members 16 and 18 and a nominally horizontal overhead sill structure 20 resting on the support members. As shown best in FIG. 2 in its closed position, a generally conventional garage door 22 is provided, formed of a plurality of substantially identical panels 24 joined together pivotably by hinges 26. The door 22 thus formed by the panels 24 is supported by rollers 28 journaled to the hinges 26 at the side edges of the door, and to brackets 30 at the top and bottoms of the side edges of the door. These rollers 28 run along a track 31 formed by two rails 32, one for each side edge of the door 22. As is generally the case, each of the rails 32 has a vertical portion 34 mounted on the inner face of the wall 12 adjacent the vertical members 16 and 18, and a generally horizontal overhead portion 36 positioned inside the enclosure 10 and smoothly and roundedly connected with the vertical portion. The distal end of overhead portion 36 is generally supported by a support bracket 37, in turn attached to an overhead support 39 in the enclosure 10, such as a garage ceiling joist.

According to the invention, there is added to the existing track 31 a second track 38, which also is formed of two rails 40. As shown in FIGS. 1 through 4, and as with rails 32, each of the rails 40 has a vertical portion 42 and a generally horizontal portion 44 smoothly and roundedly connected thereto. The second track 38 is attached to the first, or main, track 31. In particular, in the most preferred embodiment, the vertical portion 42 of the second track 38 is closely attached to the vertical portion 34 of the first track 31, with the vertical portion 34 of the first track 31 positioned between the vertical portion 42 of the second track 38 and the inner face of the wall 12. The horizontal portion 44 of the second track 38 is also mounted to the horizontal portion 36 of the first track 31, but spaced somewhat beneath the first track by mounting spacer brackets 46.

Figure 5:
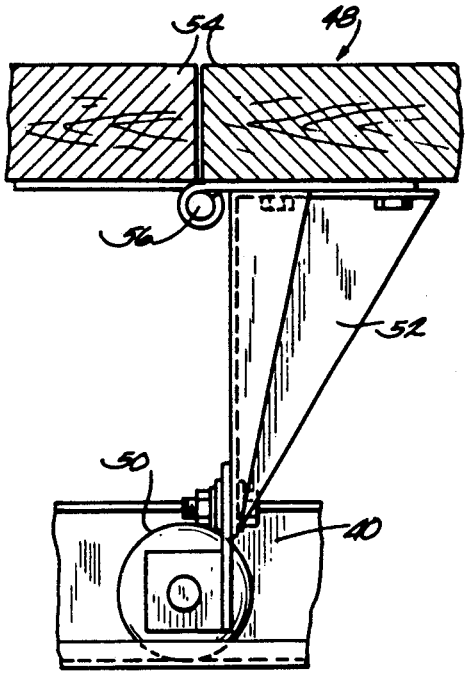
FIG. 5 is a side view, on an enlarged scale, of a fixed bracket and caster.

According to the invention, a second door 48 is mounted to the second track 38. As shown best in FIGS. 5 and 6 but can also be seen in FIGS. 2 through 4, this mounting is by means of a set of casters or rollers 50 which ride in the track 38, each of which rollers being journaled to a respective bracket 52 attached to the door 48. As with the first or main door 22, the second door 48 may be constructed of a plurality of panels 54, each adjacent pair of panels being connected pivotably together by means of hinges 56. Note that the brackets 52 for the second door 48 are longer than the existing brackets 30 for the main door 22. Since a good closure is desired when the second door 48 is in its lowered position, to keep out insects and other pests while allowing the free entry of ventilating air, the difference in the lengths of the brackets 52 and 30 is about the width of the rails 32 of the first track 31. The lengths of the brackets 52 are individually adjustable to allow for variances between the vertical support members 16, 18 and the second track 38 to assure a snug fit between the second door 48 and the support members. Since the purpose of the second door 48 is to provide additional ventilation to the enclosure, as shown in FIG. 1 one or more of the panels 54 may be constructed of a frame 55 and a foraminous or screen member 55*a* removably affixed to the frame.

Figure 7:
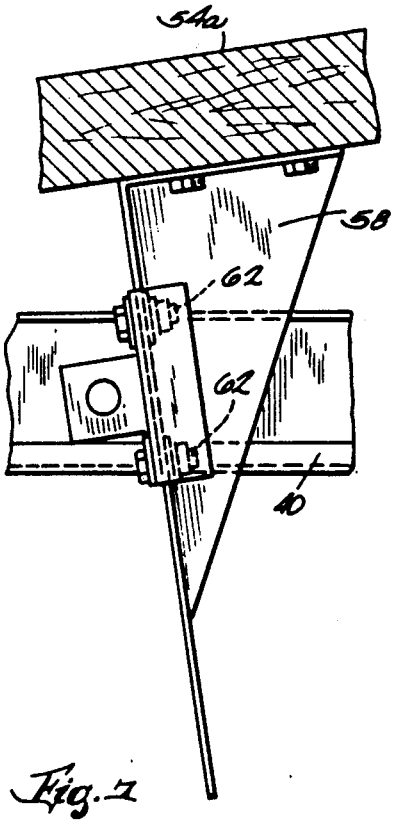
FIG. 7 is a side view, on an enlarged scale, of a sliding bracket and associated structure employed in preferred embodiment of the invention, when the screen door is in its raised position.

As can be seen by comparing FIGS. 2, 3 and 4, either the main door 22 only may be lowered, as shown in FIG. 2, or the second door 48 only may be lowered, as shown in FIG. 4, but not both at the same time. Of course both doors 22, 48 may be in their raised position at the same time, as shown in FIG. 3. Since the main door 22, in its raised position as shown in FIGS. 3 and 4, however, is still positioned very near the opening 14, it would normally interfere with the movement of the second door 48, the invention calls for passing means for permitting the top end of the second door to pass by the bottom end of the main door. In the embodiment shown herein, this passing means includes the attachment of the topmost panel 54*a* to its respective caster 50*a* by means of a sliding bracket 58, shown in detail in FIGS. 7, 8 and 9. Any suitable sliding or adjustable attachment may be employed. In the embodiment shown, the sliding bracket 58 includes slots 60 formed in the bracket. Bolts 62 are inserted through the slots 60 and affixed to a carriage 63 carrying the caster axle 66, to which the caster 50*a* itself is journaled. To permit the desired sliding the bolts 62, while tightened to the carriage 63, are not tightened to the bracket 58.

Figure 8:
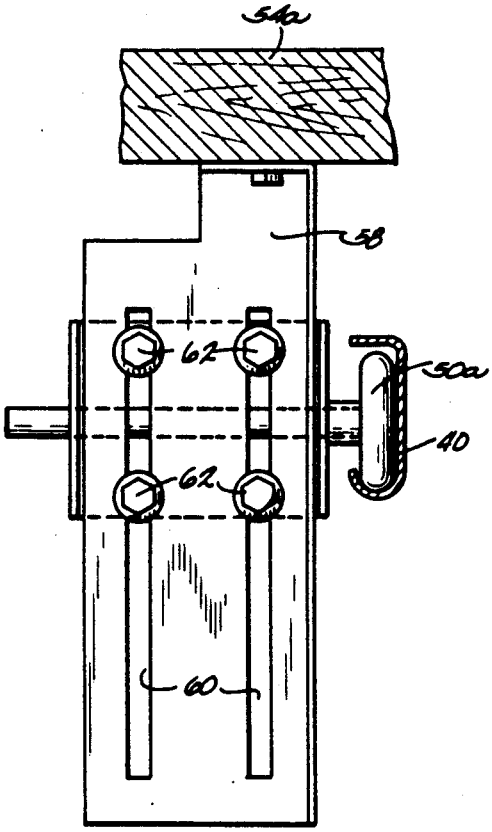
FIG. 8 is a front view of the sliding bracket and associated structure shown in FIG. 7.

In use, then, with the main door 22 in the raised position as shown in FIGS. 3 and 4, the second door 48 is lowered by running the rollers 50 along the track 38 until it reaches the bottom of the opening 14. Up to this time, the topmost panel 54*a* will be in the tilted position shown in those figures, the force of gravity the bracket 58 to slide to the ends of the slots as shown in FIG. 8. At this point, the majority of the opening 14 will be closed by the second door 48, with the exception of the topmost portion of the opening, with the topmost panel 54*a* standing away from the sill 20. The person operating the door must then pivot the topmost panel 54*a* about the topmost hinge 56*a* until it contacts the sill 20, thereby completing the closure of the opening 14.

Attachment means 64 are provided to maintain the topmost panel in the closed position in contact with the sill 20. In the embodiment shown in FIG. 9, a magnetic strip 65 is attached to the sill 20 and another corresponding strip 69 to the facing edge of the topmost panel 54*a*, for removably maintaining contact. One or more ropes 67 (FIG. 1) may be supplied to facilitate removal of the panel strip 69 from the sill strip 65. Alternatively, any suitable latching means could be used, such as a releasable latch or hook.

Figure 6:
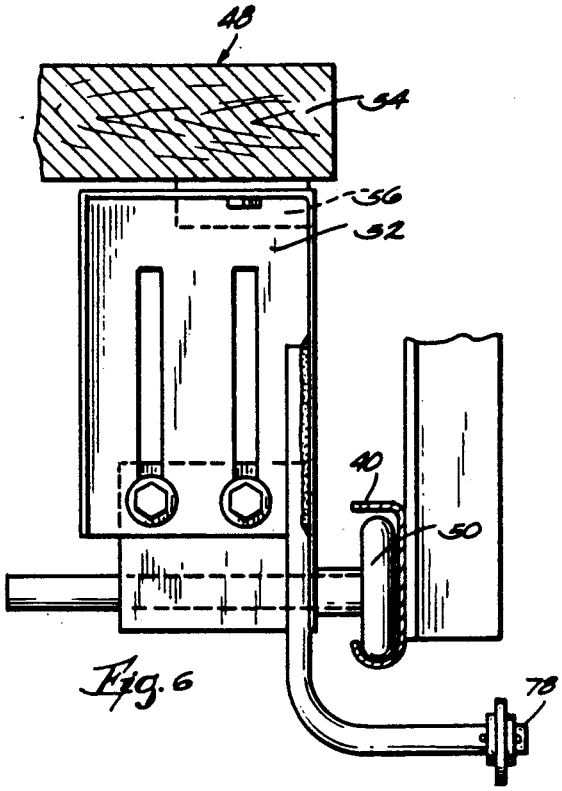
FIG. 6 is an end view, on the same enlarged scale, of the fixed bracket and caster shown in FIG. 5, and a cable end holder.

In order to facilitate the raising and lowering of the second door 48, the invention calls for counterweighting apparatus 68. In the embodiment shown herein, the counterweighting apparatus 68 includes a spring 70, cable 72 and a spring pulley 74 and a stationary pulley 76 for each side. According to this embodiment, one end of the spring 70 is affixed to the sill 20 above the top of the opening 14, while the opposite end is affixed to spring pulley 74. The cable 72 is affixed at one end to a suitable stationary point such as the bottom end of the mounting spacer bracket 46 at the distal end of the respective second rail 40. From there, the cable 72 is reeved about the spring pulley 74, then reeved about the stationary pulley 76, and finally attached to the second door 48 at a suitable point. In as shown herein, the point for attachment of the cable 72 to the second door 48 is at the upper standard bracket 52. In order to provide proper clearance, a stand-off 78, shown best in FIG. 6, is provided attached to the bracket, to which the cable 72 is attached. As can then be seen by comparing FIGS. 3 and 4, the spring 70 is relatively relaxed when second door 48 is in its raised position, and relatively taut when the door is lowered. Thus spring 70 aids in raising the door 48.

In order to improve the convenience and reliability of the counterweighting apparatus 68, a cable guide 80 is provided, as shown in isometric in FIG. 10. In the embodiment there shown, the cable guide 80 is affixed to each second rail 40. As can be seen by again comparing FIGS. 3 and 4, as the second door 48 is closed, the cable 72, carried with the door by stand-off 78, passes over the guide 80 and is thereby held more nearly parallel to the respective rail 40 as the stand-off moves along the rail. Thus the guide 80 is effective to hold the cable 72 out of the way compared to the position the cable would assume without the guide. As shown in FIG. 10, the guide 80 may be provided with a roller or sleeve 82, loosely affixed to the portion of the guide over which the cable passes, to reduce friction and wear on the cable 72 by rolling with the cable as it passes over the guide.

One embodiment of the invention calls for a safety means 84 for ensuring that a raised door, either existing door 22 or second door 48, is not lowered when the other door is already in its lowered position, since to do so could cause damage to one or both doors. As shown in FIGS. 2, 3 and 4, in this embodiment the safety means 84 includes a hook 86 which may, for convenience and to reduce the chance of loss, be attached to a chain 88, in turn attached to one of the rails 32, 40 or any other suitably convenient attachment point. A hole is provided in either one of the existing rails 32 and a corresponding one of the second track rails 40. In use, the hook 86 is inserted into one of the rails 32, 40, the particular rail being determined by the door which is in the raised position, to prevent the rollers 28, 50 from passing through that area of the respective rail. That is, for instance, in FIG. 2, where the second door 48 is in a raised position while the existing door 22 is lowered, the hook 86 is hooked into the second track rail 40 to prevent the second door from being lowered. Correspondingly, when the existing door 22 is in a raised position and the second door 48 is lowered, as shown in FIG. 4, the hook 86 is hooked into the existing rail 32 to prevent the existing door from being lowered.

While the apparatus hereinbefore described is effectively adapted to fulfill the aforesaid objects, it is to be understood that the invention is not intended to be limited to the specific preferred embodiment of screen door for large garage door opening set forth above. Rather, it is to be taken as including all reasonable equivalents within the scope of the following claims.

We claim:

1. In an enclosure provided with a vertical wall, having a pair of spaced, vertical support members and a nominally horizontal overhead sill structure cooperating to define a doorway in the wall, a first horizontally spaced track having a vertical portion mounted on the inner face of the wall adjacent said vertical members and a generally horizontal, overhead portion disposed within the enclosure and interconnected with said vertical portion, and a vertically shiftable, articulated first door shiftably carried by said track and movable between a closed position within the enclosure closing said doorway and adjacent said sill structure and an open position above said closed position, a second door apparatus comprising:

a second door including a plurality of hingedly interconnected frames, one or more of said frames presenting a central opening;

each of said frames which has such a central opening having foraminous material secured thereto in covering relationship to the opening;

a second track shiftably carrying said frames and mounted to said first tract within said enclosure, said second track having a vertical portion extending upwardly with said vertical portion of said first track and horizontally beneath said horizontal portion of said first track;

said frames being carried by said second track by means of a plurality of sets of rollers which run along said track, each said set of rollers journaled to brackets affixed to a respective one of said frames;

said frames including an uppermost frame hingedly attached to the frame below it, and attached to the uppermost one of said sets of rollers by means of a freely slidable bracket for permitting the uppermost edge of said uppermost frame to be freely shiftable between a first position where said uppermost frame edge is tiled away from the sill structure and a second position where said uppermost frame edge is in contact with the sill structure; and attachment means for releasably attached said uppermost frame edge to said sill structure so that said uppermost frame edge is attached in its second position;

whereby said second door may be shifted between a first position adjacent said sill structure and closing said doorway and a second position beneath said first door in its open position and clearing said doorway.

2. Apparatus as recited in claim 1 wherein said attachment means includes magnetic, mutually attractive strips affixed to both said sill and said uppermost frame edge.

3. Apparatus as recited in claim 1 wherein said attachment means includes releasable latch means connecting said sill and said uppermost frame edge together.

4. Apparatus as recited in claim 1 further comprising spring biasing means for counterbalancing some of the weight of said second door, for facilitating the lifting and opening of said second door apparatus.

5. Apparatus as recited in claim 1 further comprising safety means for preventing a door in the open position from moving to the closed position when the other door is already in its closed position.

6. Apparatus as recited in claim 5 wherein said safety means includes a hook removably insertable in an aperture formed in the track of the door desired to be kept in its open position.

7. Screening overhead door apparatus for screening a doorway, and for addition to existing overhead door apparatus, said existing overhead door apparatus comprising a plurality of door panels hingedly attached together one above another when in a closed position and an existing track for moving the existing overhead door apparatus between said closed position and an open position clear of said doorway, said screening door apparatus comprising:

a plurality of additional door panels, at least some of which panels having openings covered with foraminous material, said door panels hingedly attached together;

an additional track attached adjacent to said existing track so that said existing track is between said additional track and said doorway, said additional track having a vertical portion and a horizontal portion connected to and above said vertical portion;

said additional door panels being mounted to said additional track by sets of rollers, each roller of said set journaled to one of a set of brackets attached to each of said panels and running along said track, whereby said additional door panels may be moved, from a closed position adjacent and closing said doorway, to an open position clearing said doorway;

said panels including an uppermost panel hingedly attached to the panel below it, and attached to the uppermost one of said sets of rollers by means of a freely slidable bracket for permitting the uppermost edge of said uppermost panel to be freely slidable from an open position wherein said uppermost panel is pivoted away from alignment with the panel below it and a closed position wherein said uppermost panel is in sealing contact with the doorway; and attachment means for releasably attaining said uppermost panel edge to said doorway when said door panels are in said closed position and said uppermost panel is in said closed position.

8. Screening overhead door apparatus as recited in claim 7 wherein said attachment means includes magnetic, mutually attractive strips affixed to both said doorway and said uppermost panel edge.

9. Screening overhead door apparatus as recited in claim 7 wherein said attachment means includes releasable latch means connecting said doorway and said uppermost panel edge together.

10. Screening overhead door apparatus as recited in claim 7 further comprising spring biasing means for counterbalancing some of the weight of said door panels, for facilitating the lifting and opening of said apparatus.

11. Screening overhead door apparatus as recited in claim 7 further comprising safety means for ensuring that neither door apparatus is moved from the open position to the closed position when the other door apparatus is already in its closed position.

12. Screening overhead door apparatus as recited in claim 11 wherein said safety means includes a hook removably inserted in the track of the door apparatus intended to be kept in its open position.

* * * * *